US009412527B2

(12) United States Patent
Donhauser et al.

(10) Patent No.: US 9,412,527 B2
(45) Date of Patent: Aug. 9, 2016

(54) ON-LOAD TAP CHANGER

(75) Inventors: Juergen Donhauser, Schwandorf (DE); Roland Meisel, Pfreimd (DE); Christian Pircher, Lappersdorf (DE)

(73) Assignee: MASCHINENFABRIK REINHAUSEN GMBH, Regensburg (DE)

( * ) Notice: Subject to any disclaimer, the term of this patent is extended or adjusted under 35 U.S.C. 154(b) by 140 days.

(21) Appl. No.: 13/809,917

(22) PCT Filed: Jul. 7, 2011

(86) PCT No.: PCT/EP2011/003393

§ 371 (c)(1),
(2), (4) Date: Mar. 27, 2013

(87) PCT Pub. No.: WO2012/022396

PCT Pub. Date: Feb. 23, 2012

(65) Prior Publication Data

US 2013/0206555 A1 Aug. 15, 2013

(30) Foreign Application Priority Data

Aug. 18, 2010 (DE) ..... 20 2010 011 521 U

(51) Int. Cl.
*H01H 19/00* (2006.01)
*H01H 21/00* (2006.01)
(Continued)

(52) U.S. Cl.
CPC ..... *H01H 9/0005* (2013.01); *H01F 29/04* (2013.01); *H01H 9/0044* (2013.01); *H01H 9/0011* (2013.01)

(58) Field of Classification Search
CPC ..... H01H 1/00; H01H 1/56; H01H 3/00; H01H 3/02; H01H 3/04; H01H 3/08; H01H 9/0005; H01H 9/0011; H01H 9/0016; H01H 9/0027; H01H 9/0033; H01H 9/0044; H01H 9/02; H01H 9/0207; H01H 9/041; H01H 63/00; H01H 2009/0005; H01H 2009/0016; H01H 2009/0044; H01H 2009/02; H01H 2009/0285; H01H 2009/06; H01H 2009/20; H01H 2019/00; H01H 2019/14; H01H 2019/146; H01H 2221/024; H01H 2223/00; H01H 2223/044; H01H 19/00; H01H 21/00
USPC ..... 200/11 TC
See application file for complete search history.

(56) References Cited

U.S. PATENT DOCUMENTS 1,732,742 A * 10/1929 Dann et al. ..... 323/341
3,643,154 A * 2/1972 Van Riemsdijk ..... 323/340
(Continued)

FOREIGN PATENT DOCUMENTS

AT 236537 B 10/1964
DE 2529381 A 1/1977
(Continued)

OTHER PUBLICATIONS

"Stufenschalter Typ G" Machinenfabrik Reinhausen.
(Continued)

*Primary Examiner* — Edwin A. Leon
*Assistant Examiner* — Anthony R. Jimenez
(74) *Attorney, Agent, or Firm* — Andrew Wilford

(57) ABSTRACT

An on-load tap changer for uninterrupted switching between different winding taps of a regulating winding of a tapped transformer in a transformer housing has at least one selector inside the housing for power-free selection of the respective winding tap of a tapped transformer that is to be switched over to and directly juxtaposed with the winding taps. It also has, spatially separate from the selector, a load-changeover switch for the actual switching from the connected to the new, pre-selected winding tap.

5 Claims, 1 Drawing Sheet

(51) Int. Cl.
*H01H 9/00* (2006.01)
*H01F 29/04* (2006.01)

(56) References Cited

U.S. PATENT DOCUMENTS

| | | | | |
|---|---|---|---|---|
| 3,652,812 | A * | 3/1972 | Ristuccia | 200/8 R |
| 5,694,034 | A * | 12/1997 | Dohnal et al. | 323/340 |
| 6,856,122 | B2 | 2/2005 | Dohnal | |
| 7,463,010 | B2 | 12/2008 | Dohnal | |
| 2005/0099741 | A1 * | 5/2005 | Stenestam | G01R 31/3274 361/1 |
| 2011/0063064 | A1 * | 3/2011 | Albrecht | H01F 27/14 336/94 |
| 2012/0112730 | A1 | 5/2012 | Brueckl | |

FOREIGN PATENT DOCUMENTS

| | | | |
|---|---|---|---|
| DE | 676208 | B | 5/1989 |
| EP | 0140209 | A | 5/1985 |
| GB | 1514104 | B | 6/1978 |
| JP | 60177609 | B | 9/1985 |

OTHER PUBLICATIONS

"OilTap M Laststufenschalter Fuer Regeltransformatoren" Machinenfabrik Reinhausen.

* cited by examiner

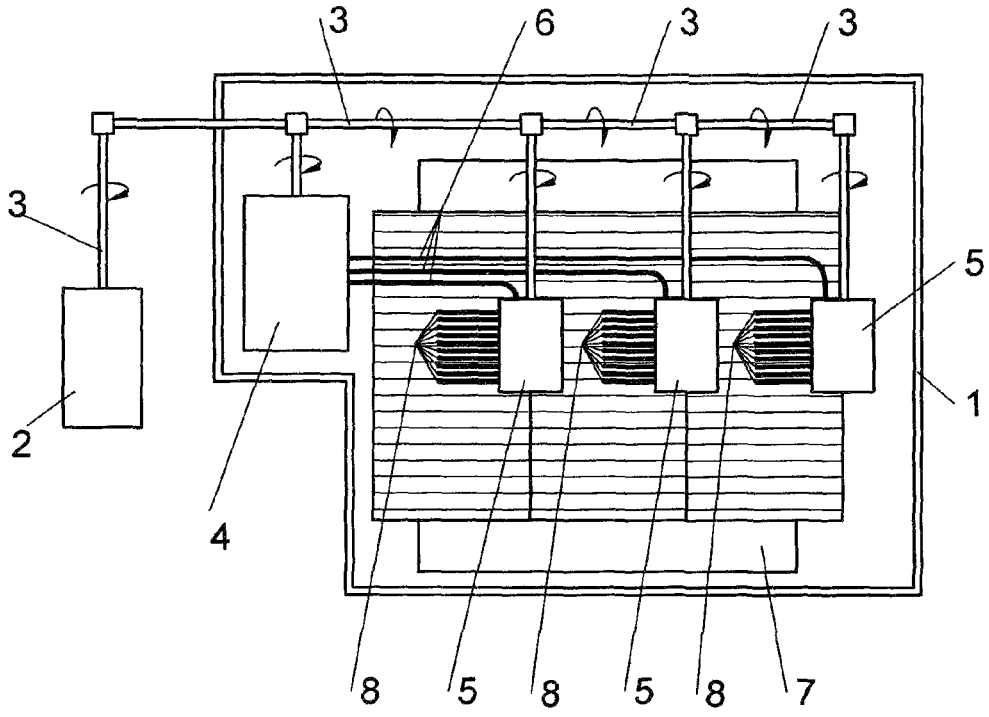
3
6
3
3
3
5
1
2
4
8
5
8
5
8
7

ON-LOAD TAP CHANGER

CROSS REFERENCE TO RELATED APPLICATIONS

This application is the US-national stage of PCT application PCT/EP2011/003393 filed 7 Jul. 2011 and claiming the priority of German patent application 202010011521.3 itself filed 18 Aug. 2010.

FIELD OF THE INVENTION

The invention relates to an on-load tap changer for uninterrupted switching between different winding taps of a tapped transformer, according to the preamble of the first patent claim and having at least one selector for power-free selection of the respective winding tap of a tapped transformer that is to be switched to and a load-changeover switch for the actual switching from the connected to the new, preselected winding tap.

BACKGROUND OF THE INVENTION

On-load tap changers serve, as is known, for uninterrupted switching between different winding taps of a tapped transformer and thus for voltage regulation. They usually consist of a selector for power-free selection of that winding tap of the tapped transformer that is to be switched to as well as a load-changeover switch for the actual uninterrupted switching from the previously connected winding tap to the new, preselected winding tap. The load-changeover switch has for that purpose the components required for such an uninterrupted rapid switching, particularly a force-storing unit, a drive shaft, switching contacts—these can be mechanical switching contacts, vacuum switching cells or also thyristors—as well as means for actuation of the switching contacts in a predetermined switching sequence for each changeover process.

Known load-changeover switches usually additionally have an individual oil vessel, usually in the form of a closed insulating-material cylinder in which all mentioned components are located separately from the surrounding oil of the transformer. Arranged to be located directly below the load-changeover switch, but in the transformer oil, is the selector, which is connected with the central drive shaft of the load-changeover switch by way of a transmission stage. The central drive shaft of the load-changeover switch is driven by way of a motor drive, which is outside the transformer housing and that slowly draws up the force-storing unit by a linkage—that is similarly led along the transformer housing at the outside—and in that case also simultaneously actuates the selector. The central drive shaft is thus responsible not only for actuation of the switching contacts of the load-changeover switch during the actual rapid switching, but also for actuation of the selector, which is directly below the load-changeover switch, during the slow drawing-up process of the force-storing unit.

On-load tap changers of that kind are products established for decades on the market and are known from, for example, the company publication of the applicant "Oiltap® M Laststufenschalter fur Regeltransformatoren." Shown on page 1 of the company publication is an on-load tap changer of the kind according to category, which has in the upper region, within the insulating cylinder, a load-changeover switch and directly adjacent thereto the selector, which is connected by way of a transmission stage with the drive shaft of the load-changeover switch. Not shown in this illustration is the force-storing unit and the motor drive in operative connection therewith by a linkage.

This described construction, which has been current for many years in the prior art, is, however, space-consuming for transformer constructors, since it takes up a relatively large amount of space within the transformer housing and thus limits the degree of freedom of the transformer manufacturer in the construction of the actual transformer in the transformer housing, which is confined in terms of space. This is not least because a relatively large space has to be left free within the transformer housing for location of the placement of the on-load tap changer and this space still cannot be flexibly designed for the purpose, but is quasi predetermined by the construction of the on-load tap changer, consisting of load-changeover switch and selector directly thereunder, known from the prior art.

The company publication "Stufenschalter Typ G" of the applicant in that case reveals a typical arrangement of an on-load tap changer according to category in the configuration, i.e. in the combination, of tap changer and regulating transformer. As apparent from the cover sheet, an on-load tap changer of that kind, thus load-changeover switch and associated selector, is at a specific dielectric spacing from the individual windings of the transformer within the transformer housing and from the walls of the transformer housing. In that case, apart from the on-load tap changer, consisting of load-changeover switch and selector directly adjoining underneath, the installation of the individual dielectrically insulated copper lines from the corresponding winding taps of the regulating winding of the transformer to the respective selector contacts requires a substantial amount of space. The line guidance, which is fastened to the transformer active part by the shunt equipment is, however, not only time-consuming in its installation, but also due to the requisite electrically conductive characteristics thereof made of copper and thus very expensive.

OBJECT OF THE INVENTION

The object of the present invention is therefore to indicate an on-load tap changer of the above-described type that allows for the transformer constructor a more flexible design possibility of the constructor's transformer and in addition makes the space-consuming and expensive line guidance inclusive of shunt equipment redundant.

SUMMARY OF THE INVENTION

This object is fulfilled by an on-load tap changer in which the at least one selector and the load-changeover switch are spatially separate from one another.

The general inventive concept consists in breaking up the previously static construction of the on-load tap changer, consisting of load-changeover switch and selector directly adjoining thereunder, and creating a physical separation of the two subassemblies of load-changeover switch and selector in that the selector is then as close as possible to the winding taps of the regulating winding of the tapped transformer. The connecting lines between the corresponding connecting contacts of the selector and the individual winding taps of the regulating winding of the tapped transformer can thus be shortened to a minimum; in particular this makes the complicated and costly line guidance together with the shunt equipment redundant.

According to a preferred embodiment of the invention the at least one selector is directly at the winding taps of the regulating winding of the transformer, thus in the interstice thereof. Due to the fact that the previously provided space for the selector within the transformer housing can thus be eliminated and instead thereof this can be placed in the already present space of the interstice, i.e. directly at the winding taps of the regulating windings of the transformer winding, the physical separation of the subassemblies of load-changeover switch and selector creates space in the transformer housing.

According to a further preferred embodiment of the invention the linkage that connects the motor drive with the force-storing unit of the load-changeover switch is led directly in the interior of the transformer housing onward from the load-changeover switch to the selector and thus used in a particularly simple manner to also drive the selector.

According to yet a further embodiment of the invention the linkage is in that case no longer led, as in the past, to the outer side of the transformer housing along the upper side thereof and only there connected with the force-storing unit of the on-load tap changer, but led directly through a lateral wall of the transformer housing.

According to yet a further preferred embodiment of the invention the load-changeover switch and the at least one selector are each actuated by a specific drive, for example in the form of a motorized direct drive. This makes the previously functionally necessary central motor drive inclusive of complicated linkage to the load-changeover switch superfluous and can be directly above or below the load-changeover switch or the at least one selector. If the motorized direct drive is a linear motor or torque motor, then in the case of the load-changeover switch it is also possible to dispense with the otherwise functionally obligatory spring force-storing unit.

BRIEF DESCRIPTION OF THE DRAWING

The invention is explained in more detail in the following by way of a single drawing FIGURE, showing a schematic illustration of an on-load tap changer according to the invention with physically separated load-changeover switch and selector.

SPECIFIC DESCRIPTION OF THE INVENTION

FIG. 1 shows a transformer housing 1 whose interior holds a yoke 7 carrying at least one winding, comprising a main winding and a regulating winding with winding taps 8. In addition, a motor drive 2, which by way of a linkage 3 produces an operative connection with a load-changeover switch 4 in the interior of the transformer housing 1 and with at least one selector 5, is provided at the outer lateral wall of the transformer housing 1. The load-changeover switch 4, which is illustrated in this FIG. 1 only in very abstract form, is a load-changeover switch 4 that has become known from, for example, the already mentioned company publication "Oiltap® M Laststufenschalter fur Regeltransformatoren" of the applicant. This load-changeover switch 4 is electrically connected with the corresponding selector 5 by way of lines 6.

According to the invention the at least one selector 5 is positioned directly at the winding taps 8 of the regulating winding of the transformer, which shortens the connecting lines between the corresponding connecting contacts of the selector and the individual winding taps 8 of the regulating winding of the tapped transformer to a minimum. In particular, with the solution according to the invention the connecting lines, which are complicated in installation and in addition expensive, together with the shunt equipment are redundant. The linkage 3 driven centrally by a single motor drive 2 is so constructed that it is in operative connection not only with the load-changeover switch 4, but also with the at least one selector 5.

The invention claimed is:

1. An on-load tap changer for uninterrupted switching between different winding taps of a regulating winding of a tapped transformer in a transformer housing, the tap changer comprising:

at least one selector inside the housing in the immediate spatial vicinity of and directly juxtaposed with the winding taps of the regulating winding of the tapped transformer for power-free selection of a one of the winding taps of the tapped transformer that is to be switched over to, and a load-changeover switch inside the housing for the actual switching from a connected one of the winding taps to the selected one winding tap, the at least one selector and the load-changeover switch being spatially separate from one another.

2. The on-load tap changer according to claim 1, wherein the at least one selector and the load-changeover switch are drivable by a common linkage.

3. The on-load tap changer according to claim 2, wherein the linkage extends through a lateral wall into the transformer housing and extends at least partly therein.

4. The on-load tap changer according to claim 1, wherein the at least one selector and the load-changeover switch are actuatable by a linear motor or a torque motor.

5. The on-load tap changer according to claim 1, wherein there is a plurality of selectors of identical construction.

* * * * *